US005678501A

United States Patent [19]

Rosso

[11] Patent Number: 5,678,501

[45] Date of Patent: Oct. 21, 1997

[54] LINKING MACHINE WITH A CONVEYOR TO TRANSPORT SOCKS TO SEWING HEADS

[75] Inventor: Pietro Rosso, Torino, Italy

[73] Assignee: Rosso Industrie S.p.A., Orbassano, Italy

[21] Appl. No.: 569,156

[22] PCT Filed: Apr. 27, 1995

[86] PCT No.: PCT/EP95/01607

§ 371 Date: Dec. 21, 1995

§ 102(e) Date: Dec. 21, 1995

[87] PCT Pub. No.: WO95/30039

PCT Pub. Date: Nov. 9, 1995

[30] Foreign Application Priority Data

Apr. 28, 1994 [IT] Italy ..... 94000084 U

[51] Int. Cl.[6] ..... D05B 7/00; D05B 19/16; D05B 27/00

[52] U.S. Cl. ..... 112/470.04; 112/27; 112/470.15

[58] Field of Search ..... 112/27, 25, 26, 112/470.04, 470.01, 470.05, 470.06, 470.08, 470.14, 470.15, 475.07, 475.12

[56] References Cited

U.S. PATENT DOCUMENTS

| | | | |
|---|---|---|---|
| 4,359,956 | 11/1982 | Sakonishi | 112/27 X |
| 4,718,365 | 1/1988 | Hauser et al. | 112/470.04 X |
| 5,109,785 | 5/1992 | Inoue et al. | 112/470.04 |

*Primary Examiner*—Peter Nerbun

*Attorney, Agent, or Firm*—Cohen, Pontani, Lieberman & Pavane

[57] ABSTRACT

A linking machine in which three stepper motors are provided which adjust the opening width between the two rails of a conveyor, the height of the rails of the conveyor, and the vertical position of an edge trimmer with respect to the plane of transport of the socks. The stepper motors are actuated by drivers from a microprocessor which, in its turn, can be controlled via a keyboard. The keyboard is connected with a display which displays the data of each individual adjustment as well as the data of the program selected.

3 Claims, 5 Drawing Sheets

LINKING MACHINE WITH A CONVEYOR TO TRANSPORT SOCKS TO SEWING HEADS

BACKGROUND OF THE INVENTION

1. Field of the Invention

The present invention relates to a linking machine having a conveyor for transporting socks.

2. Description of the Prior Art

From Italian patent application 67 725 - A/90 a flat linking machine is known which has a conveyor for transporting socks that is composed of two rails which are arranged below a horizontal supporting bracket that is mounted on a vertical wall of the linking machine. In order to be able to adjust the distance between the two rails to a specific type of sock, one of the two rails—the inner rail, which is located closer to the wall—is stationary, while the outer rail can be displaced in a horizontal direction.

In one embodiment of this linking machine, the outer rail is supported by two end projections of an elongated member which has an upside down U-shape and is received in a seat which is worked into a supporting bracket and is larger in a horizontal direction than the elongated member. Springs, which are arranged spaced from and parallel to each other and extend at right angles to the front wall of the supporting bracket, press against the elongated member. A threaded hole is provided in the front wall, into which a bolt of a rotary knob is screwed which can be actuated from outside the front wall. Between the front wall and the rotary knob there is a check knob, the purpose of which is to stabilize the set position.

The supporting bracket on which the two rails are mounted has, in the vicinity of the vertical wall, a hole, into which a bolt engages. The bolt is firmly attached to the supporting bracket by a clamp screw. The two ends of the bolt are guided in coaxial holes, provided in sections of the vertical wall. A coil spring which is placed over the bolt presses the bracket, and with it the bolt, upward against a threaded pin of a rotary knob. The pin is screwed into a threaded hole which is provided in a horizontal rib of the vertical wall and lies above the part of the bracket which is opposite the front wall. By actuating the rotary knob, the vertical position of the supporting bracket, and with it both of the two rails, can be adjusted. In order to exclude unavoidable play, a clamping lever is provided, which has a horizontal bolt which extends through the vertical wall and is screwed into a threaded hole in the side of the supporting bracket facing the vertical wall. A flange, having a diameter greater than the passage opening in the vertical wall through which the threaded pin of the clamping lever is passed is firmly attached to the clamping lever. In this way, the supporting bracket can be pulled against the vertical wall after the height of the bracket has been adjusted, whereby any rotation around the axis of the bolt connected to the supporting bracket is avoided.

The construction described has proven very reliable and easily adjustable in practice. To be sure, for the initial setting and, in particular, for setting the width of the opening between the two rails the use of a thickness gauge is necessary in order to check the setting. This operation cannot be carried out by the operator of the linking machine but must be carried out by a setter. The setter must set the width of the opening of the guide slot when there is a change of the type in sock which is to be linked. Furthermore, for the adjustment of the height of the supporting bracket two parts must be actuated, namely the rotary knob and the clamping lever, so that this work is cumbersome to carry out and must be finally checked.

SUMMARY OF THE INVENTION

The object of the present invention is therefore to provide a linking machine which does not have the indicated disadvantages and in which not only the setting of the width of the opening between the two rails and the setting of the height of the bracket bearing them but also the setting of the height of the edge trimmer relative to the chain guide conveyors which transport the socks to the sewing heads can be effected very rapidly and accurately by the operator of the linking machine himself, without the need for a special setter.

In a linking machine having a conveyor for transporting socks, which has a stationary rail and a movable rail which are arranged on a horizontal supporting bracket which is arranged on a vertical wall attached to the frame of the linking machine and is adjustable in height with respect to said wall, and having an edge trimmer, this object is achieved, in accordance with the invention, in the manner that electric stepper motors are provided for the moving of the rail and of the supporting bracket and for the adjustment of the height of the edge trimmer, which motors are connected to a programmable electronic control unit which, by the actuation of a few control keys, places the motors in forward or reverse motion and stores and calls up the parameters which refer to the position of the rails with respect to each other, to the position in height of the supporting bracket, and to the vertical position of the edge trimmer relative to chains which transport the sock to be linked to sewing heads.

In accordance with a preferred embodiment of the invention, the supporting bracket is displaceable vertically relative to the wall, and relative turning between the two of them is prevented when the stepper motor is connected for axial displacement of the supporting bracket.

In this connection, it can be provided that the vertical frame fastened to the stand of the linking machine has two pins which are movable vertically with respect to the frame and can each be acted on from above by a spring. The pins are adjustable in height together with the supporting bracket via a stepper motor which is fastened on the supporting bracket and has a shaft a threaded section of which engages into a threaded bushing which is fastened in the central region of the vertical frame.

Further features and advantages of the invention will become evident from the description of an embodiment which is shown in the drawing.

DETAILED DESCRIPTION OF THE PREFERRED EMBODIMENTS

Figure 1:
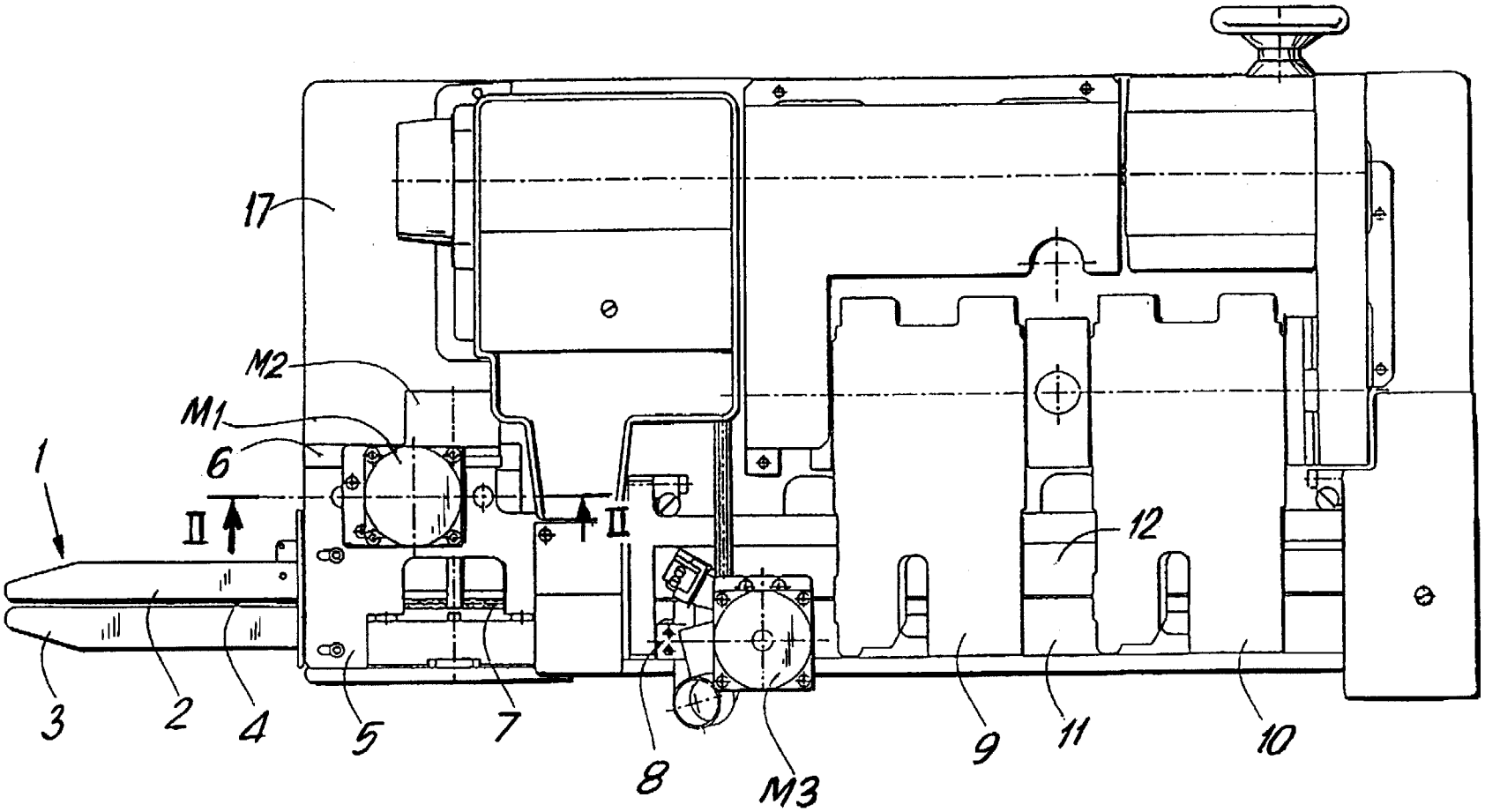
FIG. 1 is a diagrammatic top view of a linking machine in accordance with the present invention.

As shown in FIG. 1, the flat linking machine has a conveyor 1 with an inner rail 2 and an outer rail 3 which is movable, so that the width of the drive slot 4 between the facing edges of the two rails can be adjusted. The rails 2, 3 are arranged on the bottom of a supporting bracket 5 which, in its turn, is fastened on a vertical wall 6 or a frame which is firmly attached to the stand of the linking machine. Chains 7 serve to introduce the socks to be linked and to advance them to an edge trimmer 8 having a stationary knife and a movable knife which are located above further chains which transport the socks to sewing heads 9, 10. The sewing heads are indicated diagrammatically and are fastened to the bottom of lengthwise members 11, 12.

Figure 2:
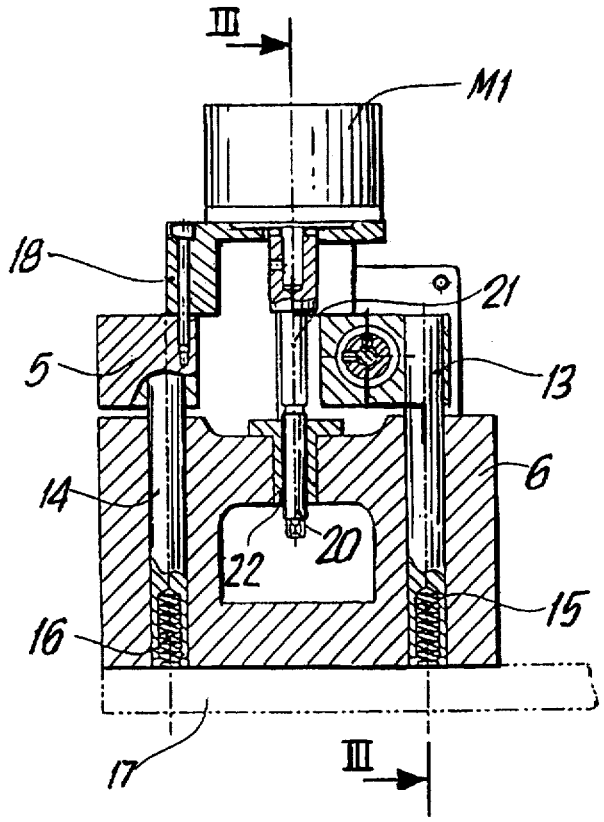
FIG. 2 is a cross section along the line II—II of FIG. 1.
Figure 3:
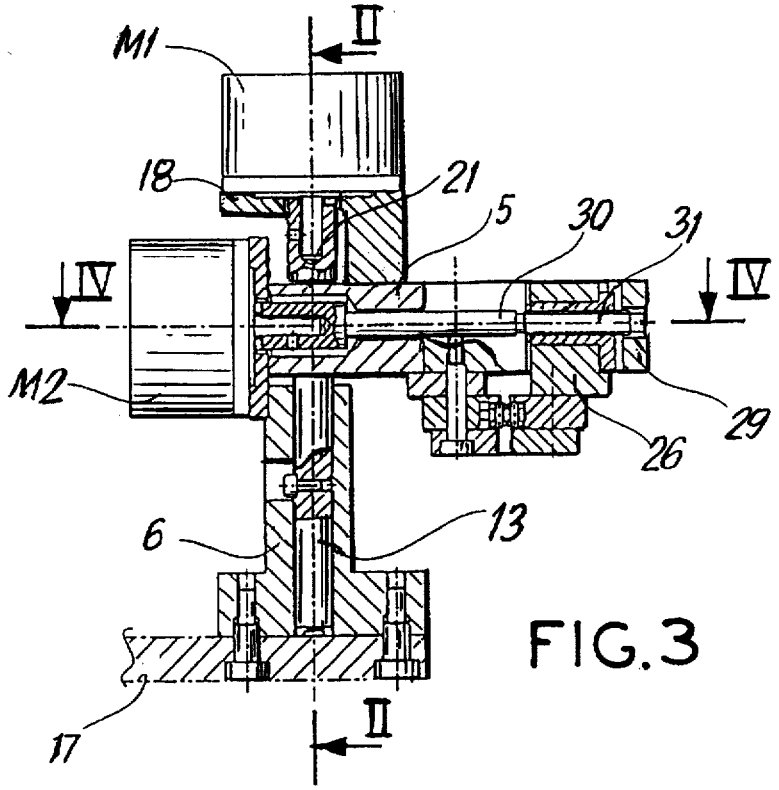
FIG. 3 is a cross section along the line III—III of FIG. 2.
Figure 4:
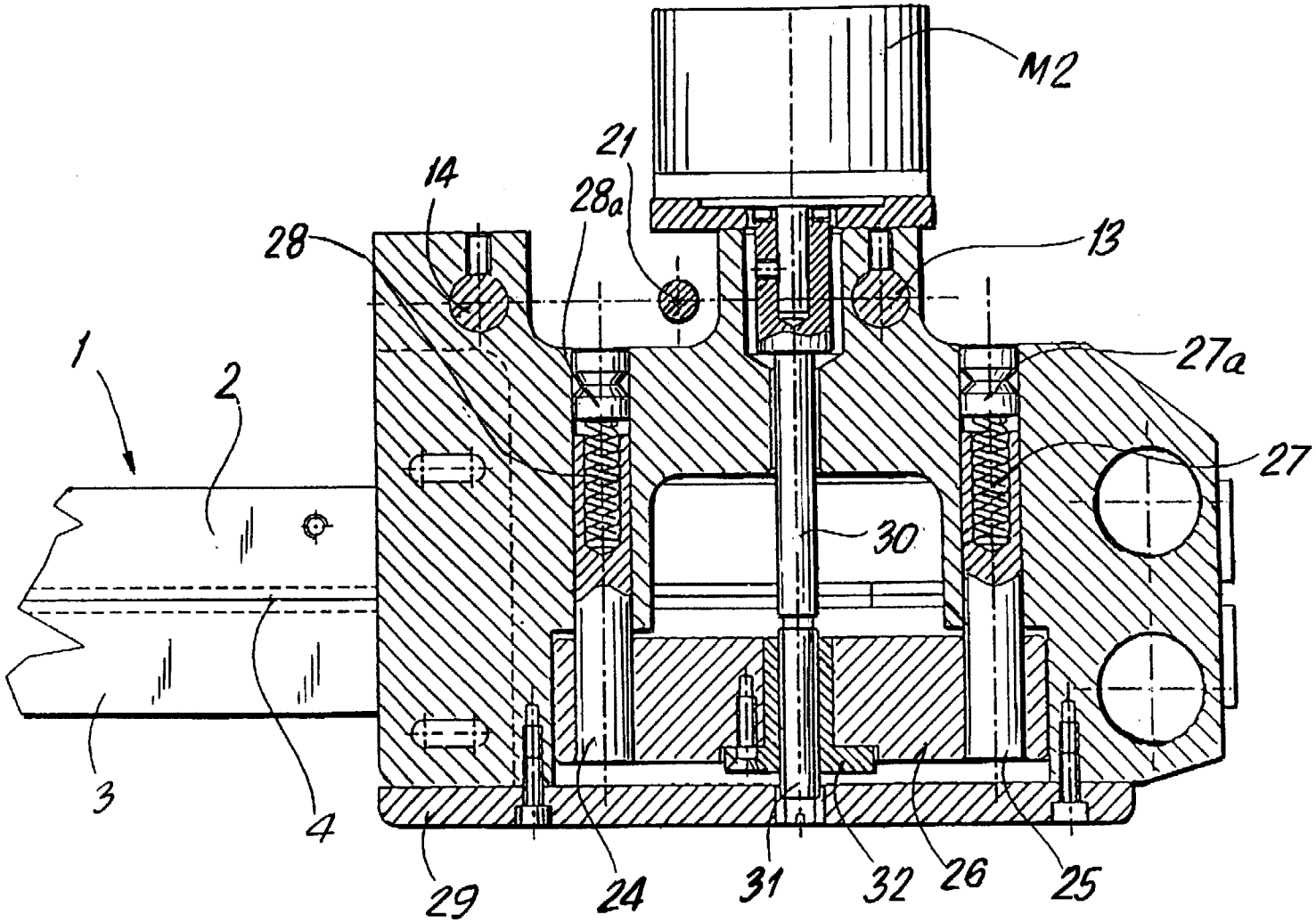
FIG. 4 is a cross section along the line IV—IV of FIG. 3.

FIGS. 2 to 4 show the vertical frame 6 through which two vertical pins 13, 14 pass which are pressed upward by springs 15, 16, respectively, which rest against the horizontal wall 17 of the stand of the linking machine. The upper ends of the two pins 13, 14 engage into passage holes in the supporting bracket 5 (see FIG. 2). On the supporting bracket 5 there is fastened a support 18 of a stepper motor M1. A shaft 21 of the motor M1 is provided at its lower end with a threaded section 20 which is screwed into a threaded bushing 22 which, in its turn, is fastened in a central opening in the vertical frame 6. When, upon actuation of the motor M1, the threaded section 20 of the shaft 21 is screwed into the bushing 22, a downward movement of the supporting bracket 5 and a compressing of the two springs 15 and 16 results.

A further stepper motor M2 is arranged on the supporting bracket 5. FIG. 4 shows that there are two horizontal pins 24, 25 present in the supporting bracket 5, which are fastened by screws to a lengthwise member 26. Two springs 27, 28 rest against closure plugs 27*a*, 28*a*, respectively, which close off the holes in which the pins 24, 25 are seated. The two springs 27, 28 press the pins 24, 25 in the direction towards the front wall 29 of the horizontal supporting bracket 5. The shaft 30 of the motor M2 has a threaded section 31 which engages in a threaded bushing 32 which is fastened in the lengthwise member 26. The lengthwise member 26 bears the outer rail 3 so that, upon turning on the motor M2, the rail 3 is moved relative to the inner rail 2 to adjust the width of the guide slot 4 between the edges of the two rails 2, 3 which face each other.

Figure 5:
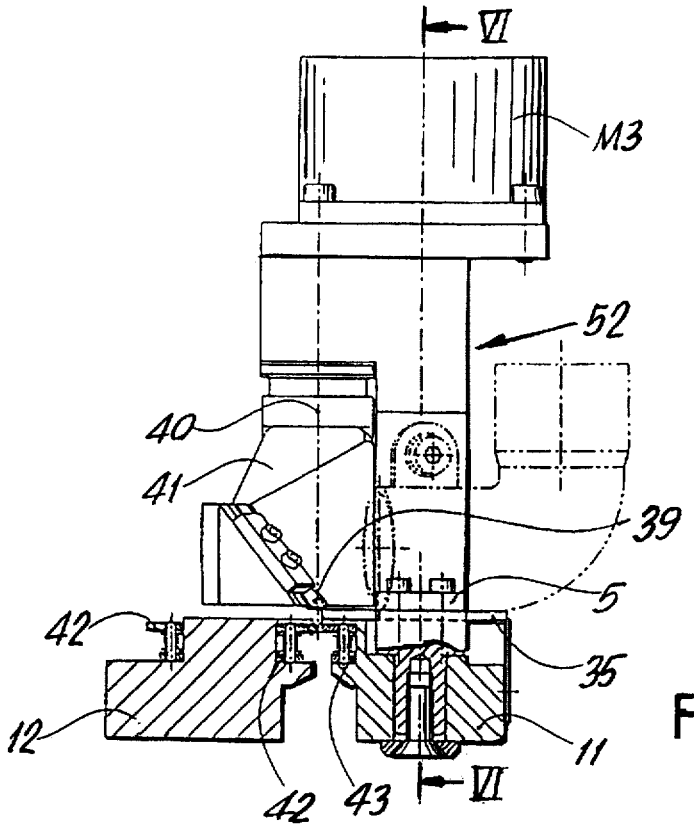
FIG. 5 is a view, partly in section, of the device for the displacement in height of the movable knife of the edge trimmer which cuts off the edge of the sock which protrudes beyond the chains leading to the sewing heads.
Figure 6:
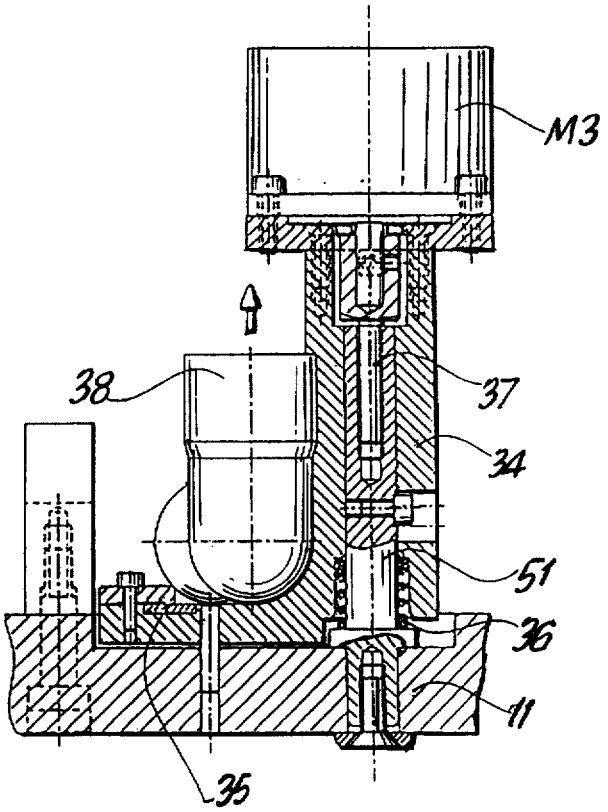
FIG. 6 is a cross section along the plane VI—VI of FIG. 5.

From FIGS. 5 and 6 it can be noted that a third stepper motor M3 is provided, by which the vertical position of the edge trimmer 52 can be adjusted. In this connection, a spring 36 is provided which is placed on a bolt 51 fastened on the lengthwise member 11. The spring 36 presses vertically upward against a support 34 on which the motor M3 is fastened. When the motor M3, via its shaft, turns a threaded pin 37 which is engaged in the bolt 51 in one direction or the other, the support 34 and with it a movable knife 39 are also displaced vertically. The knife 39 (FIG. 5) can be turned around the axis 40 and is fastened on a holding member 41 which is firmly attached to the support 34. A mating knife 35 is also provided. In FIGS. 5 and 6, there can also be noted an elbow pipe 38 via which the sections which have been cut off can be drawn away. Finally, two chains 42, 43, which transport the sock to the, sewing heads 9, 10 are also shown.

Figure 7:
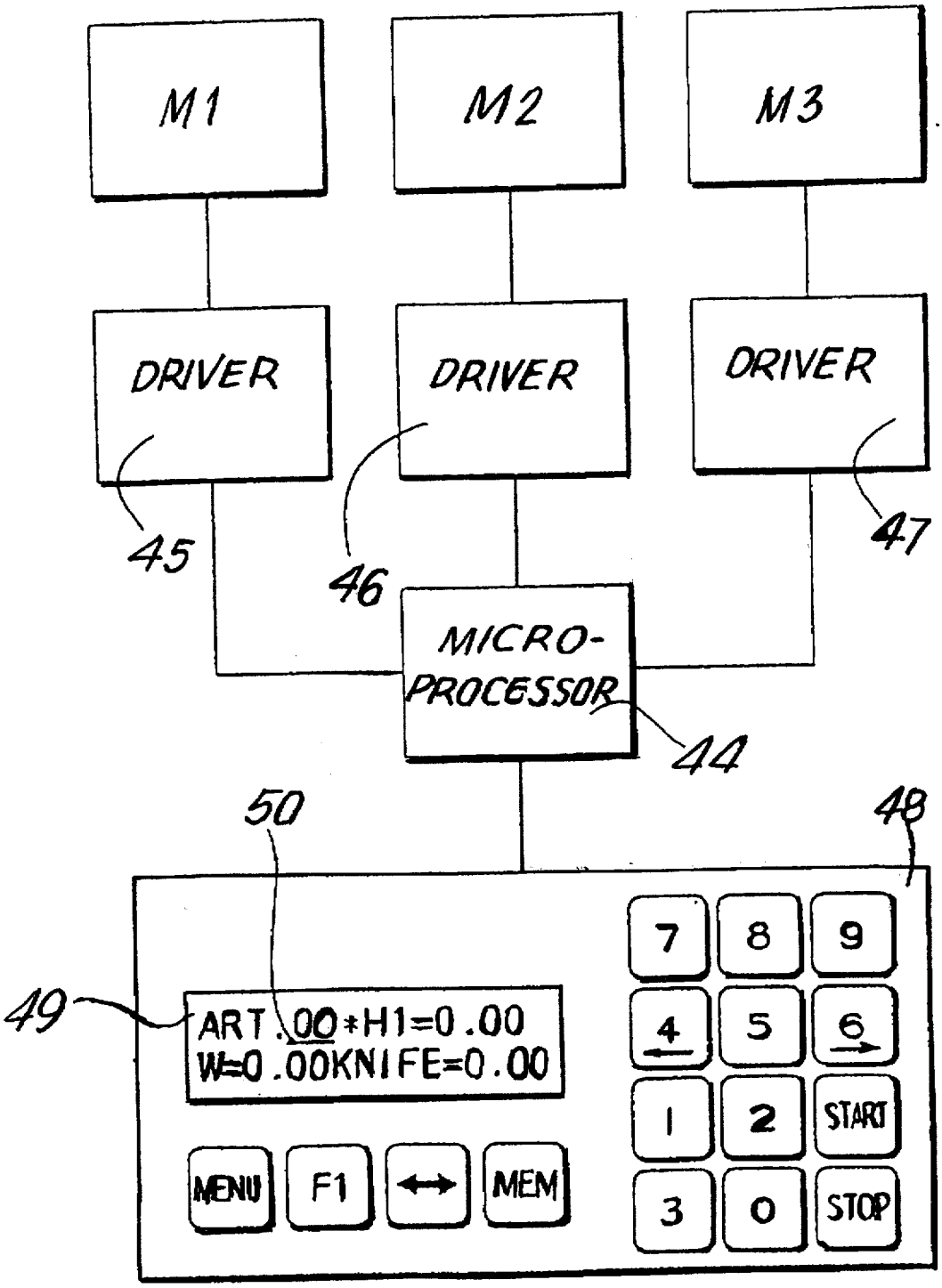
FIG. 7 is a diagrammatic representation of the device for the control of the actuating members for controlling the width of the opening between the rails, the setting height thereof, and the vertical position of the knife of the edge trimmer can be adjusted.

FIG. 7, schematically illustrates the control device for setting the width of the opening of the guide slot 4 between the facing edges of the rails 2 and 3, the position in height of the supporting bracket 5 on which the two rails are arranged and the vertical position of the edge trimmer 52. This control device is constructed and operates as follows:

A microprocessor 44 is provided which conducts control pulses to so-called "drivers" 45, 46 and 47 (electronic control cards or circuit boards as drive means) and converts them into commands for the corresponding motors M1, M2 and M3. Via a keyboard 48, the pulses are forwarded to the microprocessor 44. For this purpose twelve keys 0 to 9, "Start" and "Stop", which are arranged in the right-hand region of the keyboard and/or four keys, "MEM", "<-->", "F1"and "Menu" arranged on the bottom left, can be actuated.

The so-called display 49 on which the cursor 50 appears during the operating system is located above the last-mentioned four keys.

The keys provided with the number 4 and 6 bear two further symbols namely "<--" and "-->" respectively, the meaning of which will be explained further below.

When the linking machine is connected in operation to a source of power, the name of the manufacturer as well as the designations "Art.00", "H1=0.00", "W=0.00" and "KNIFE 0.00", which refer to data with regard to the type of sock which is to be linked, the position in height of the rails of the conveyor 1, the width of the opening of the guide slot 4 between the two rails, and the position in height of the edge trimmer 52, appear on the display 49 for awhile. When the "<-->" key is then depressed, the cursor 50 moves in such a manner that the corresponding values can be entered. When the last value has been entered, i.e. the position in height of the edge trimmer 52, the "Start" key is depressed so that the motors M1, M2 and M3 are connected, whereby the values entered are automatically stored and the cursor returns to the "Art.00" field. When one or more values on the display 49 are to be changed, the "F1" key is depressed, whereupon the corrections are indicated in the manner that the cursor is displaced accordingly and the "<--" key is depressed if the corresponding value is to be reduced, or the "-->" key is depressed if the value is to be increased as compared with the value previously stored. This operation is completed when the keys which have been depressed are released. If, thereupon, the "F1" key is again depressed, the automatic operation continues. Upon the depressing the "Menu" key, the number of socks linked is indicated on the display 49. By means of the "Stop" key the number of socks can be reset to zero.

The "MEM" key is practically not used by the operation of the linking machine.

From the description, it is evident that it is very easy, in accordance with the invention, for the operator of the linking machine not only to effect corrections but also to switch the linking machine, which is set up for the linking of one type of sock, rapidly and easily to a different type of sock, for which purpose the corresponding article number with the three settings already stored need merely be called up via the keyboard 49.

One advantage of the invention is that the system shown in FIG. 7 is also excellently suited, due to the use of a microprocessor, to carry out functions other than those mentioned above. Thus, for instance, sensors can be provided which detect a break of the thread at the sewing heads. With such an occurrence, a pulse can then be sent to the keyboard which indicates this break of thread on the display 49 and at the same time stops the linking machine.

In addition to the embodiment shown and described, changes are possible within the scope of the inventive concept. The description refers to a flat linking machine; of course, the invention can also be used, with the same advantages, in the case of a round linking machine. Furthermore, it is possible for the inner rail 2 to be movable and the outer rail 3 stationary.

I claim:

1. A linking machine for socks, comprising:

a stand;

a vertical wall fixed to the stand;

a horizontal support bracket connected to the vertical wall so as to be vertically moveable;

an edge trimmer mounted to the stand, said edge trimmer being vertically adjustable;

sewing heads mounted to the stand;

first conveyor means for transporting the socks to the edge trimmer, the first conveyor means including a stationary rail and a moveable rail mounted to the support bracket and wherein a slot is defined between the rails;

second conveyor means including chains for transporting the socks from the edge trimmer to the sewing heads;

first electric stepper motor means for moving the moveable rail;

second electric stepper motor means for moving the support brackets;

third electric stepper motor means for adjusting the edge trimmer relative to the chains; and programmable electronic control means for controlling the first, second and third electric stepper motor means, the control means including control keys which are operative to selectively place the first, second and third electric stepper motor means in forward and reverse operation, the control means being operative to store and call up parameters that define a mutual position of the rails, a vertical position of the support bracket, and a vertical position of the edge trimmer relative to the chains.

2. A linking machine according to claim 1, and further comprising means for axially displacing the support bracket whereby relative turning between the support bracket and the vertical wall is prevented; and means for connecting the support bracket to the vertical wall wherein the support bracket is vertically adjustable relative to the vertical frame.

3. A linking machine according to claim 2, wherein the vertical wall has a central bore and two vertical bores, the connecting means including:

a threaded bushing fixed in the central bore of the vertical wall, the second stepper motor means being mounted on the support bracket and having a shaft with a threaded section that is engaged with the threaded bushing;

two pins respectfully, slidably arranged in the vertical bores of the vertical wall, each of the pins having a first end connected to the support bracket and a second end in the vertical bore; and spring means arranged in each of the vertical bores for urging the pins upwardly, the second stepper motor means being operative to adjust the height of the support bracket and the pins.

* * * * *